US006034655A

United States Patent [19]

You

[11] Patent Number: 6,034,655

[45] Date of Patent: Mar. 7, 2000

[54] METHOD FOR CONTROLLING WHITE BALANCE IN PLASMA DISPLAY PANEL DEVICE

[75] Inventor: Eun Ho You, Kyungki-do, Rep. of Korea

[73] Assignee: LG Electronics Inc., Seoul, Rep. of Korea

[21] Appl. No.: 08/886,452

[22] Filed: Jul. 1, 1997

[30] Foreign Application Priority Data

Jul. 2, 1996 [KR] Rep. of Korea ..... 96-26758

[51] Int. Cl.[7] ..... G09G 3/28

[52] U.S. Cl. ..... 345/60; 345/63; 345/68

[58] Field of Search ..... 345/60, 63, 68, 345/72, 88, 83, 87; 315/169.4

[56] References Cited

U.S. PATENT DOCUMENTS 5,708,453 1/1998 Tsuchida et al. ..... 345/87

5,724,054 3/1998 Shinoda ..... 345/60

*Primary Examiner*—Richard A. Hjerpe

*Assistant Examiner*—Anthony J. Blackman

[57] ABSTRACT

Method for controlling a white balance in a plasma display panel device, is disclosed, including the steps of (1) displaying one frame of gradation on an entire screen of the plasma display panel device, (2) discharging and erasing all cells in the plasma display panel device, (3) addressing all R cells, G cells, or B cells of the entire cells at a time; and (4) providing additional sustain pulses having numbers different from one another to the R cells, G cells and B cells addressed in the step (3) to reduce luminance differences between the R cells, G cells and B cells, thereby providing additional sustain pulses with numbers different from one another in the order of R cell>G cell>B cell to R cells, G cells, B cells after display of one frame of gradation on an entire screen, resulting in significant reduction of luminance differences between the R cells, G cells, B cells caused by provision of identical gradation data thereto, whereby facilitating implementation of a stable white balance and exact colors and has an advantage of improving a brightness of the entire screen.

4 Claims, 4 Drawing Sheets

METHOD FOR CONTROLLING WHITE BALANCE IN PLASMA DISPLAY PANEL DEVICE

BACKGROUND OF THE INVENTION

1. Field of the Invention

The present invention relates to a plasma display panel (PDP) device, and more particularly, to a method for controlling a white balance in a plasma display panel device, in which a R(Red) cell, a G(Green) cell and a B(Blue) cell are applied of additional sustain pulses having numbers different from one another after display of one frame of picture to reduce differences of luminances between the R, G, B cells when the same gradation data are provided thereto, for implementation of a stable white balance.

2. Discussion of the Related Art

Referring to FIG. 1, a conventional plasma display panel device includes a plasma display panel 1 having a plurality of address electrode lines and first and second sustain electrode lines disposed thereon, a controlling part 2 for generating digital R, G, B video data(gradation data) to be provided to the plurality of address electrode lines, first and second sustain pulses to be provided to the first and second sustain electrode lines respectively, and different control signals, in response to external signals, address driving parts 3 and 3' each for providing the digital R, G, B video data to the plurality of address electrode lines in response to control signals from the controlling part 2, and first and second sustain driving parts 4 and 5 for providing the first and second sustain pulses to the plurality of first and second sustain electrode lines respectively in response to control signals from the controlling part 2.

Referring to FIG. 2, the plasma display panel 1 includes N numbers of first sustain electrode lines $X_1, X_2, ---, X_{N-1}, X_N$ and second sustain electrode lines $Y_1, Y_2, ---, Y_{N-1}, Y_N$ formed at fixed intervals alternatively, and M numbers of R, G, B address electrode lines $R_1, G_1, B_1, R_2, G_2, B_2, ---, R_{M-1}, G_{M-1}, B_{M-1}, R_M, G_M, B_M$ formed at fixed intervals at right angles to the first and second sustain electrode lines $X_1 \sim X_N$ and $Y_1 \sim Y_N$.

The method for displaying a motion picture or a still picture on the aforementioned plasma display panel with a subfield system will be explained.

The subfield system has an X number of subfields in a frame, with each of the subfields corresponded to one of luminances having relative ratios of 1:2:4:8:16:32:64, - - - , for implementing gray levels of $2^X$, thereby a picture corresponding to a number of gradation of $0 \sim 2^X - 1$ can be displayed by combining a certain number of the subfields. That is, the controlling part 2 controls the first and second sustain driving parts 4 and 5 to provide reset pulses to the first and second sustain electrode lines $X_1 \sim X_N$ and $Y_1 \sim Y_N$ to make the charges in all the cells in the plasma display panel 1 discharged and erased so that all the cells will not be affected by previous luminescence. Then, the first and second sustain driving parts 4 and 5 provide scan pulses to the first and second sustain electrode lines $X_1 \sim X_N$ and $Y_1 \sim Y_N$ respectively and, on the same time, the address driving parts 3 and 3' provide one bit of digital R, G, B video data to respective address electrode lines $R_1 \sim B_M$, to excite and make luminous of particular cells to each of which 1(high pulse) is provided as a value of the bit. In general, widths of the reset pulses for discharge and erase of all the cells are narrower than widths of the scan pulses. Next, the controlling part 2 controls the first and second sustain driving parts 4 and 5 to provide first and second sustain pulses as much as a number of first subfields to the first and second sustain electrode lines $X_1 \sim X_N$ and $Y_1 \sim Y_N$ respectively to maintain the luminosity of the particular cells for a predetermined duration required for the first subfields. When the aforementioned steps of discharging and erasing all cells, providing digital R, G, B video data, and providing first and second sustain pulses, are performed repeatedly for the rest of the subfields, one frame of picture can be displayed on the plasma display panel 1.

In the gray scale implementation with the aforementioned subfield system, luminances of the R, G, B cells by the gradation data(digital video data) provided to the R, G, B cells are dependent on numbers of the first and second sustain pulses provided to the plurality of subfields, and a combination of the luminance of the R, G, B cells forms a color of a pixel. In other words, combinations of red, blue, green visible lights emitted at proper luminances from the R, G, B cells in the pixel depending on the digital R, G, B video data(each has a number of bits identical to a number of subfields) provided to address electrode lines Ra, Ga, Ba for the three R, G, B cells for one frame duration implements various colors of the pixel. If the R, G, B cells in the pixel are provided with the same gradation data, white color (achromatic color) is displayed theoretically, and if provided with gradation data different from one another, various colors can be displayed according to ratios of the luminances of the R, G, B cells.

However, because luminous efficiencies of the R, G, B fluorescent materials coated on the R, G, B cells respectively on the plasma display panel are, as known, in general in the order of G fluorescent material>R fluorescent material>B fluorescent material, if discharge space sizes of the R, G, B cells and numbers of the sustain pulses corresponding to the gradation data of the R, G, B cells are the same as the known art, there has been problems that an imbalance in the white balance is occurred such that a greenish white is displayed in an implementation of a white color on a pixel and exact implementations of other colors are not possible because the luminances of the R, G, B cells according to the provided same gradation data are in the order of G cell>R cell>B cell.

And, as can be known from the varied luminances of the R, G, B fluorescent materials depending on the varied current intensities per unit area shown in TABLE 1 below and the R fluorescent material basis relative comparison of the luminous efficiencies of the R, G, B fluorescent materials (also shown by a graph in FIG. 3), because a luminous efficiency of the G fluorescent material increases and a luminous efficiency of the G fluorescent material decreases as a luminance of a screen increases, causing a greater difference between luminances of the G cell and the B cell, as a luminance of a white becomes the higher, the white becomes the more greenish, causing the more serious imbalance in the white balance.

TABLE 1

Luminances of R, G, B fluorescent materials according to varied current intensity

| current intensity ($\mu A/cm^2$) | | 0.9 | 1.8 | 2.7 | 4.5 | 6.3 | 9.0 | 18.0 | 27.0 | 36.0 |
|---|---|---|---|---|---|---|---|---|---|---|
| Luminance (N-T) | R | 1800 | 3200 | 4800 | 7400 | 10000 | 12000 | 23000 | 32000 | 40000 |
| | G | 2100 | 4400 | 6800 | 12000 | 17000 | 22000 | 43000 | 63000 | 85000 |
| | B | 600 | 920 | 1200 | 1400 | 1800 | 2050 | 3000 | 4000 | 5000 |
| Relative ratio (R based) | G | 1.17 | 1.37 | 1.41 | 1.62 | 1.7 | 1.83 | 1.87 | 1.96 | 2.13 |
| | B | 0.33 | 0.29 | 0.25 | 0.19 | 0.18 | 0.17 | 0.13 | 0.125 | 0.11 |

SUMMARY OF THE INVENTION

Accordingly, the present invention is directed to a method for controlling a white balance in a plasma display panel device that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for controlling a white balance in a plasma display panel device includes the steps of (1) displaying one frame of gradation on an entire screen of the plasma display panel device, (2) discharging and erasing all cells in the plasma display panel device, (3) addressing all R cells, G cells, or B cells of the entire cells at a time; and (4) providing additional sustain pulses having numbers different from one another to the R cells, G cells and B cells addressed in the step (3) to reduce luminance differences between the R cells, G cells and B cells.

The numbers of the additional sustain pulses provided to the R cells, G cells and B cells in the step (4) may be made to be in an order of B cell>R cell>G cell considering luminous efficiency differences among R, G, B fluorescent materials.

The numbers of the additional sustain pulses provided to the R cells, G cells and B cells in the step (4) may be varied to appropriate ratios according to luminance or contrast of the screen for keeping the white balance stable regardless of variation of the luminance or contrast of the screen.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiment of the present invention, examples of which are illustrated in the accompanying drawings. Since a system of a plasma display panel of the present invention is identical to the system of the conventional plasma display panel, the system of the present invention is not shown.

Figure 4:
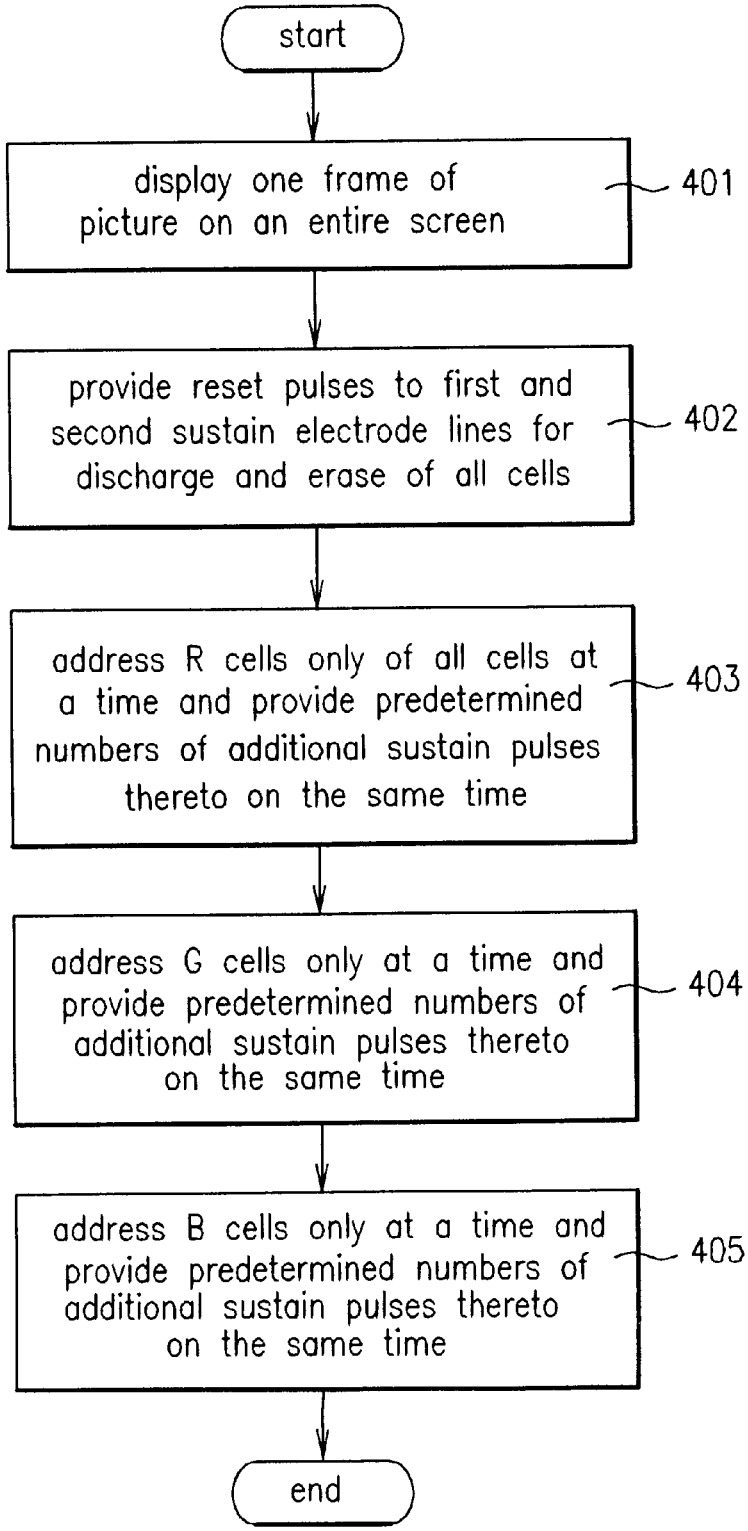
FIG. 4 illustrates a flow chart showing the steps of a method for controlling a white balance in a plasma display panel device in accordance with a preferred embodiment of the present invention; and, FIGS. 5*a* and 5*b* illustrates timings of first and second sustain pulses in accordance with a preferred embodiment of the present invention.

FIG. 4 illustrates a flow chart showing the steps of a method for controlling a white balance in a plasma display panel device in accordance with a preferred embodiment of the present invention.

The method for controlling a white balance in the aforementioned plasma display panel device in accordance with a preferred embodiment of the present invention will be explained.

Figure 5A:
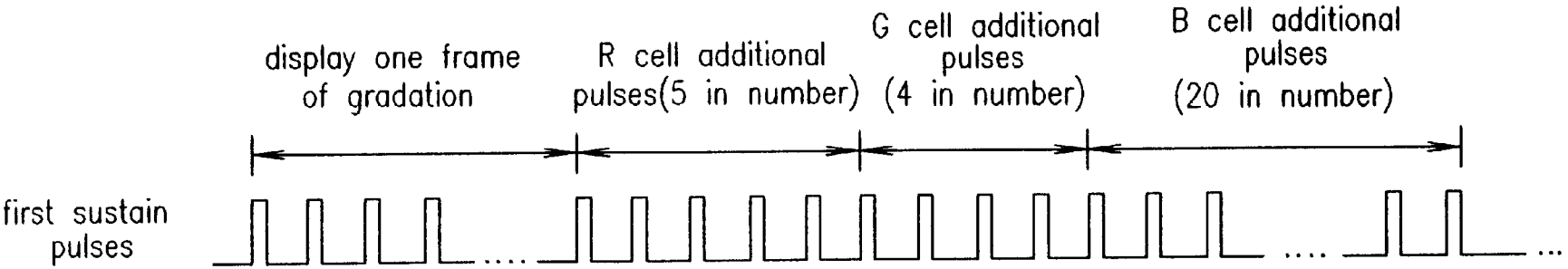
Figure 5B:
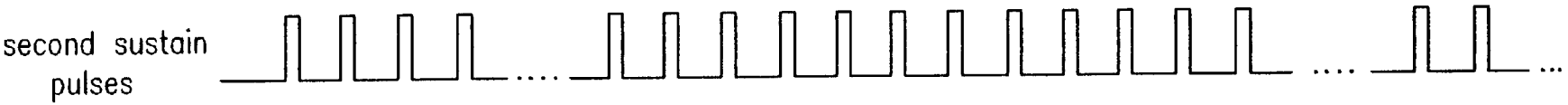

The method starts with a step of displaying one frame of picture by a step identical to the conventional method (S401). That is, in the plurality of subfields of a frame, the gradation data(digital R, G, B video data) and the first and second sustain pulses are provided in succession to every subfield to display one frame of gradation on the entire screen. If one frame of picture is displayed on the entire screen by the performance of the step 401, the controlling part 2 controls the first and second sustain driving parts 4 and 5 to provide reset pulses to the first and second sustain electrode lines respectively to discharge and erase all the cell(S402) to prevent all the cells from being affected by prior luminances. After the discharge and erase of all the cells in the step 402, the controlling part 2 controls the address driving parts 3 and 3' to provide bit values of 1 to only the plurality of R address electrode lines among the address electrode lines in the plasma display panel 1 to address only the R cells among entire cells at a time, and, on the same time, controls the first and second sustain driving parts 4 and 5 to provide additional predetermined numbers of first and second sustain pulses respectively to the first and second sustain electrode lines to make luminances of the entire R cells higher(S 403). With the same method as the above, first and second sustain pulses of predetermined numbers different from each other are additionally provided to the G cells and B cells among the entire cells to make luminances of the cells higher(S404 and S405). The numbers of the sustain pulses provided additionally to the R, G, B cells are made to be in the order of B cell>R cell>G cell considering the fact that the luminous efficiency differences of the R, G, B fluorescent materials are in the order of G fluorescent material>R fluorescent material>B fluorescent material. For example, as shown in FIGS. 5*a* and 5*b*, after displaying one frame of gradation on the entire screen, if additional 5, 4 and 20 of the first and second sustain pulses are provided to the entire R, G, B cells respectively, resulting in addition of luminances to the R, G, B cells in the order of B cell>R cell>G cell, implementation of a stable white balance and exact colors are made possible because of reduction of the luminance differences between the R, G, B cells.

Figure 1:
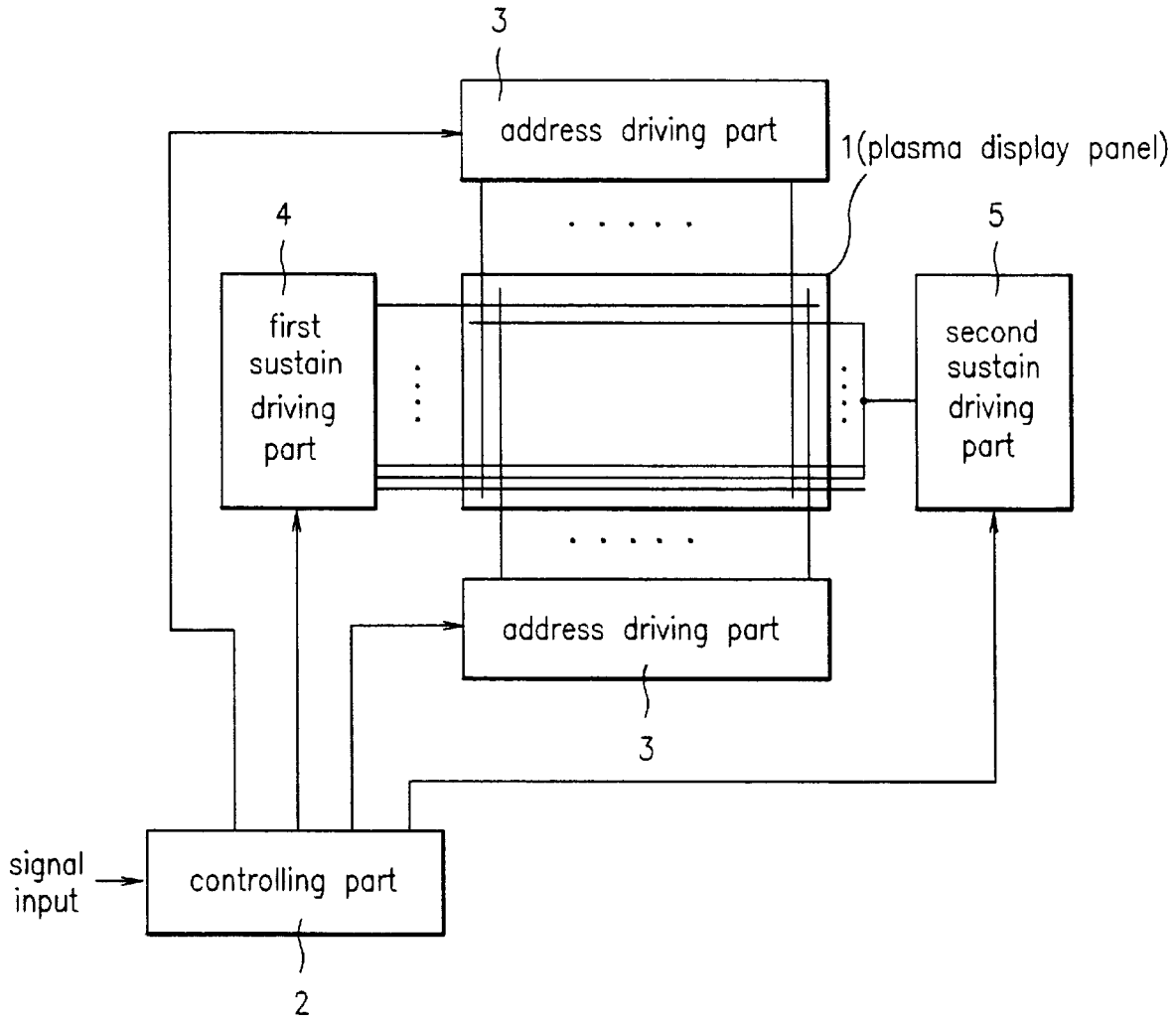
F I G.1 prior art
FIG. 1 illustrates a schematic block diagram of a system of a conventional plasma display panel device.
Figure 2:
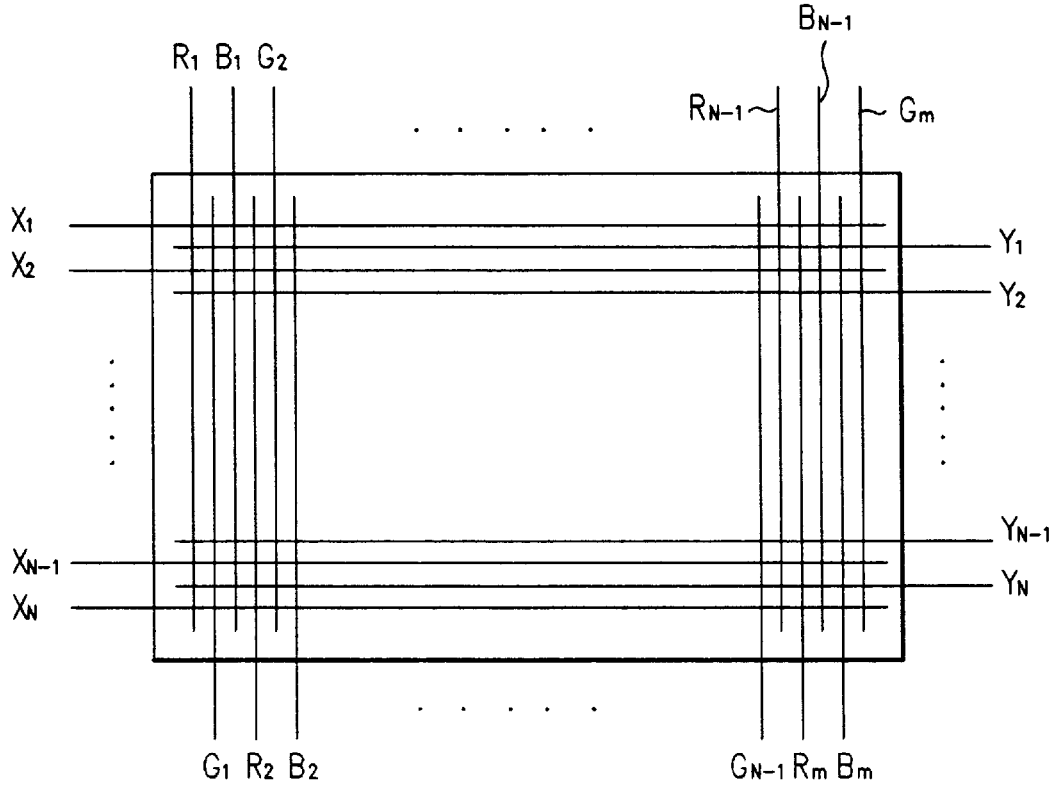
FIG. 2 illustrates a configuration of electrodes in the plasma display panel shown in FIG. 1.
Figure 3:
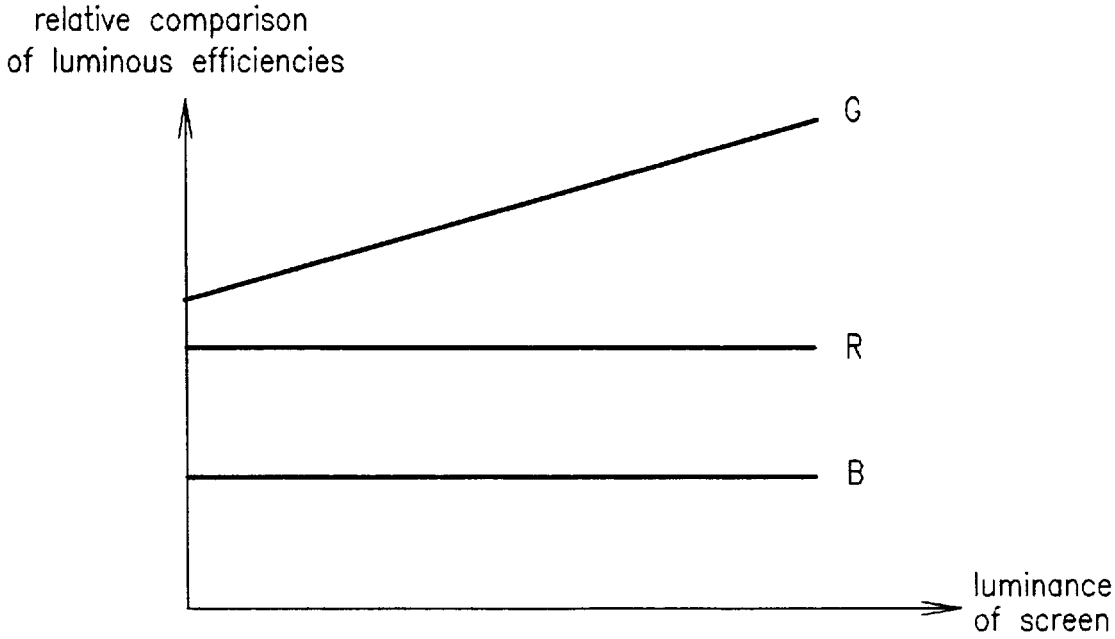
FIG. 3 illustrates a graph showing a relative comparison of luminous efficiencies of R, G, B fluorescent materials according to variation of a screen luminance.

Moreover, in the present invention, in order to compensate for the increase of the luminance difference between the G cells and the B cells according to the increase of the luminance of the screen as shown in FIG. 3 coming from the increase of luminous efficiency of the G fluorescent material and the decrease of the B fluorescent material, numbers of the additional first and second sustain pulses provided to the R cells, G cells and B cells may be varied to an appropriate ratio depending on luminance of the screen. That is, if the numbers of the additional first and second sustain pulses provided to the R cells, G cells and B cells are varied to an appropriate ratio depending on variation of luminance of the screen, an uniformity of the stable white balance can be provided.

In the meantime, the varied ratio of numbers of the additional first and second sustain pulses may be provided to the R cells, G cells and B cells depending on, not only the variation of luminance of the screen, but also variation of contrast of the screen.

As has been explained, by providing additional sustain pulses with numbers different from one another in the order of R cell>G cell>B cell to R cells, G cells, B cells after display of one frame of gradation on an entire screen, resulting in significant reduction of luminance differences between the R cells, G cells, B cells caused by provision of identical gradation data thereto, the method for controlling a white balance in a plasma display panel device of the present invention facilitates implementation of a stable white balance and exact colors and has an advantage of improving a brightness of the entire screen.

Moreover, by varying numbers of the additional sustain pulses to an appropriate ratio provided to the R cells, G cells, B cells depending on variation of luminance or contrast of the screen, an uniformity of the white balance can be provided.

It will be apparent to those skilled in the art that various modifications and variations can be made in the method for controlling a white balance in a plasma display panel device of the present invention without departing from the spirit or scope of the invention. Thus, it is intended that the present invention cover the modifications and variations of this invention provided they come within the scope of the appended claims and their equivalents.

What is claimed is:

1. A method for controlling a white balance in a plasma display panel device comprising the steps of:

(1) displaying one frame of gradation on an entire screen of the plasma display panel device;

(2) discharging and erasing all cells in the plasma display panel device;

(3) addressing all R cells, G cells, or B cells of the entire cells at a time; and, (4) providing additional sustain pulses having numbers different from one another to the R cells, G cells and B cells addressed in the step (3) to reduce luminance differences between the R cells, G cells and B cells.

2. A method as claimed in claim 1, wherein the numbers of the additional sustain pulses provided to the R cells, G cells and B cells in the step (4) are made to be in an order of B cell> R cell> G cell considering luminous efficiency differences among R, G, B fluorescent materials.

3. A method as claimed in claim 1, wherein the numbers of the additional sustain pulses provided to the R cells, G cells and B cells in the step (4) are varied to appropriate ratios according to a luminance of the screen.

4. A method as claimed in claim 1, wherein the numbers of the additional sustain pulses provided to the R cells, G cells and B cells in the step (4) are varied to appropriate ratios according to a contrast of the screen.

* * * * *